US005381968A

United States Patent [19]

Lohnherr et al.

[11] Patent Number: 5,381,968

[45] Date of Patent: Jan. 17, 1995

[54] APPARATUS AND METHOD FOR THE CRUSHING OF MATERIAL FOR GRINDING OF DIFFERING GRAIN SIZE

[76] Inventors: Ludger Lohnherr, Am Kirchplatz 4, 4740 Oelde; Ludger Kimmeyer, Im Werl 40; Walter Holz, Im Vinkendahl 2, both of 4720 Beckum 2; Bernhard Zigan, Papenbrede 16, 4724 Diestedde; Werner Schoneich, Gustav-Moll-Str. 35, 4720 Beckum, all of Germany

[21] Appl. No.: 51,607

[22] Filed: Jul. 13, 1992

[30] Foreign Application Priority Data

Jul. 23, 1991 [DE] Germany ..... 4124416

[51] Int. Cl.[6] ..... B02C 23/30; B02C 9/04

[52] U.S. Cl. ..... 241/19; 241/24; 241/52; 241/80; 241/79.1; 241/119

[58] Field of Search ..... 241/19, 24, 49, 52, 241/53, 58, 60, 61, 81, 76, 79, 79.1, 80, 117–121, 97, 57

[56] References Cited

U.S. PATENT DOCUMENTS 3,951,347 4/1976 Tiggesbaumker et al. ..... 241/80 X
4,498,633 2/1985 Williams ..... 241/81 X
4,550,829 11/1985 Tanaka et al. ..... 241/80 X
4,586,658 5/1986 Eisenegger ..... 241/80 X
4,919,341 4/1990 Lohnherr ..... 241/80 X
4,927,086 2/1990 Henne et al. ..... 241/80
4,982,905 1/1991 Holsiepe et al. ..... 241/80

*Primary Examiner*—Timothy V. Eley
*Attorney, Agent, or Firm*—Learman & McCulloch

[57] ABSTRACT

Fresh raw material is delivered to a crushing zone for crushing. Beforehand, fine particles are separated from the raw material by means of an airstream and directed into the housing of the crusher where they are entrained by an independent gas stream that conveys crushed fines upwardly to a separator also located within the housing. The separator removes fine particles from the system and returns the remaining, relatively course tailings material to the crushing zone through a tailings return chute. At least a portion of the material exiting the tailings return chute is subjected to a secondary separation treatment to capture additional quantities of fine particles before entering the crushing zone. The captured tailings material may be mixed with the fresh raw material else reintroduced into the top of the separator to receive the secondary separation treatment.

16 Claims, 2 Drawing Sheets

APPARATUS AND METHOD FOR THE CRUSHING OF MATERIAL FOR GRINDING OF DIFFERING GRAIN SIZE

The invention relates to apparatus and to a method for the crushing of material for

BACKGROUND OF THE INVENTION

In a roller mill with an air separator arranged immediately above it, it is known from EP-A-370 267 to provide a device by means of which fresh material for grinding is delivered to the rotating grinding table (with grinding rollers rolling on it). This delivery device is constructed like a material feed chute and is provided on its base which runs obliquely downwards with two air inlet channels through each of which an air stream can be delivered in such a way that proportions of fines can be separated out from the freshly delivered material for grinding and delivered to the air separator, as a result of which the crushing device is relieved of the proportions of fines which have been separated out and thus its crushing efficiency should be improved.

The object of the invention is to make further improvements in such a way that by relatively simple measures at least an additional increase in efficiency can be achieved in the crushing of material for grinding.

SUMMARY OF THE INVENTION

In this construction according to the invention—by contrast with the known construction according to EP-A-370 267 described above—not only is the fresh material for grinding which is to be delivered to the crushing device relieved of proportions of fines by a kind of primary separation, but also at least a part of the oversize material (tailings) to be delivered from the tailings outlet of the separator to the crushing device is subjected to secondary separation in order to separate out a substantial proportion of the sufficiently fine particles still contained in this oversize material. For this purpose a suitable secondary separating device is arranged in the region between the tailings outlet of the separator and the re-introduction point for this oversize material into the crushing device in order to separate out fine particles from this oversize material.

In the studies on which the invention is based it was shown that the oversize material which comes from the separator in the form of grit is frequently charged with a relatively high proportion of fine material (finished material) which has already been sufficiently reduced in size. Since further over-grinding of this fine material contained in the returned oversize material costs additional energy, it is already extremely advantageous if at least a sufficiently large proportion of this fine material still contained in the returned oversize material is separated out by means of the secondary separation before this oversize material is drawn into the grinding tools of the crushing device. These grinding tools and thus the entire crushing device can therefore be relieved of the proportions of fine material which are separated out, as a result of which particularly good preconditions are created not only improving the crushing work but also for further increasing the crushing efficiency of the crushing device.

According to a particularly simple construction, the secondary separating device can be constructed approximately in the form of a material chute with a base running obliquely downwards, to which is connected at least one inlet channel for separating air which is controllable in its flow cross-section. A secondary separating device constructed in this way can if required be arranged parallel, i.e. independently of the feed device for the fresh material for grinding.

However, if the device for feeding the fresh material to crushing device is also constructed in the form of a fresh material feed chute with its base running obliquely downwards and at least one inlet channel for separating air connected to the base, then it can also be particularly advantageous if the tailings outlet of the separator is connected by a conveyor device to this fresh material feed chute and this fresh material feed chute simultaneously forms the secondary separating device for at least the greatest proportion of the oversize material returned from the separator to the crushing device or for all the returned oversize material. In this way oversize material coming from the separator can be delivered to the fresh material feed chute and thus to the fresh material for grinding in such a way that on the one hand a common separation of fresh material for grinding and returned oversize material is carried out, in which case all the fine particles which are separated out can be jointly delivered to the separator. On the other hand, with this common separation an extremely intensive intermixing of the freshly delivered material for grinding (feed material) with the returned oversize material is also brought about, so that a very uniform mixture of total material for grinding can be delivered to the crushing tools of the crushing device, which further favours the crushing work in this crushing device.

It should be emphasised at this point that for the overall construction of the apparatus according to the invention it is generally possible to arrange at least the crushing device and the separator as separate devices, and also that both a dynamic air separator (with rotating separating elements) and a static air separator (without rotating separating elements) can be provided as the separator, and that for the crushing device any construction can be provided which is suitable for the crushing of material for grinding with differing grain size, particularly for more or less brittle mineral material.

According to a particularly preferred embodiment of this apparatus according to the invention, however, the crushing device is constructed in the form of a roller mill which is known per se with a vertical axis and with grinding tools (grinding rollers or grinding balls) rolling on a rotatable grinding table, and the separator is arranged as an air separator in a manner which is known per se immediately above the roller mill in a common device housing with this roller mill. In this case the mechanical conveyor device, preferably a screw conveyor, connects a simple material chute or the like, the tailings outlet of this air separator to the secondary separating device, which can be formed simultaneously by the fresh material feed chute in a particularly compact construction of the overall apparatus according to a construction described above.

The invention will be described in greater detail below with the aid of several embodiments which are illustrated in the drawings. In the drawings:

THE DRAWINGS

DETAILED DESCRIPTION

Figure 1:
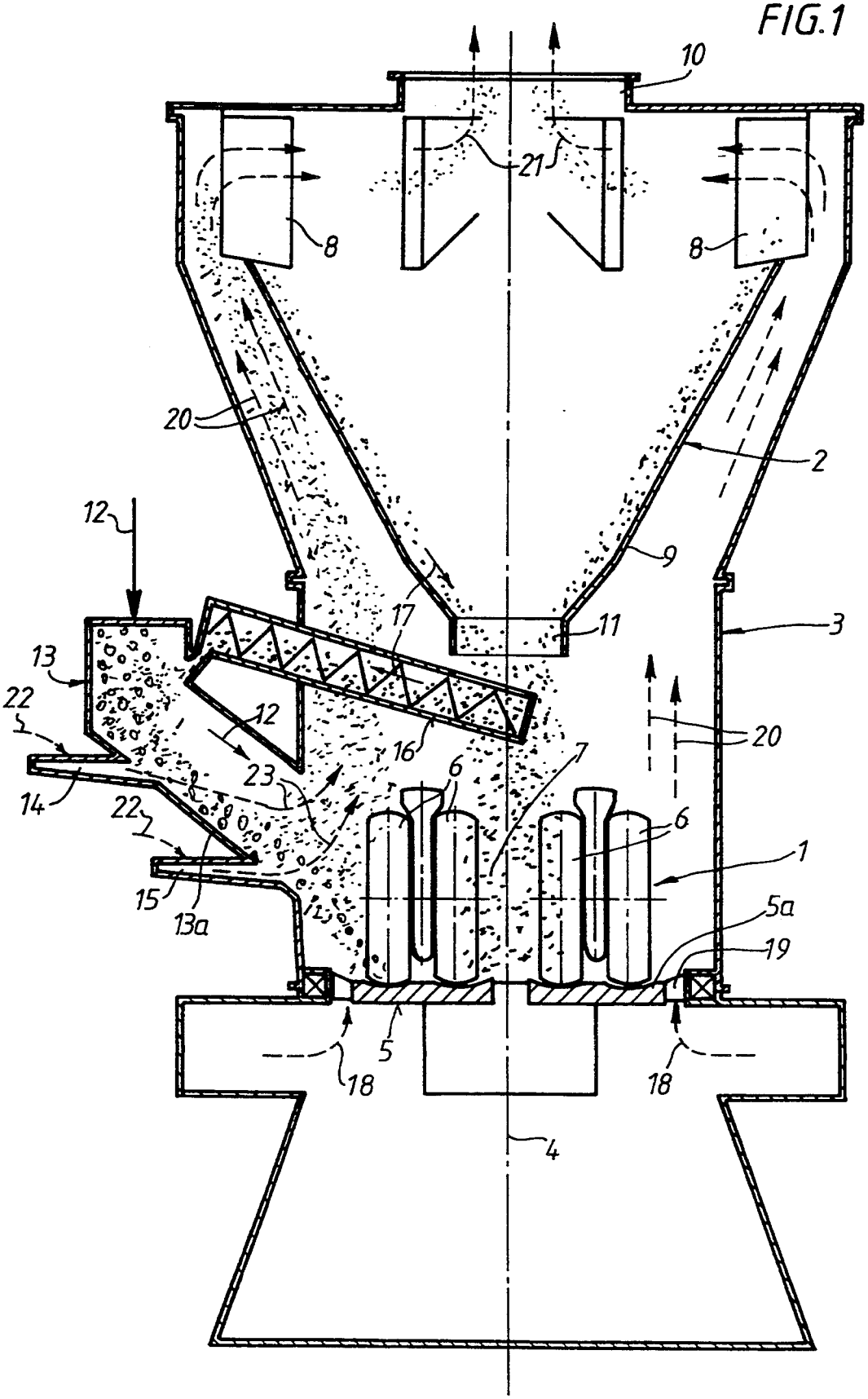
FIG. 1 shows a schematic vertical sectional view through a roller mill with a separator arranged above it in a construction according to the invention.

In the first embodiment which is illustrated in FIG. 1, the crushing apparatus according to the invention is provided as a particularly preferred and extremely compact structural unit consisting of a crushing device in the form of roller mill 1 which is known per se and with a vertical axis and an air separator 2 (in a form which is equally known per se) arranged immediately above it. The roller mill 1 and the air separator 2 arranged above it are—as is also known per se—accommodated in a common device housing.

The roller mill 1, which is only shown schematically, is equipped in the usual way with a grinding table 5 which is driven so as to be rotatable about the vertical axis of the device with an upper annular grinding track 5*a* on which the grinding rollers, which are held stationary, roll so that material for grinding which is delivered is crushed between the grinding track 5*a* and the grinding rollers 6.

In this embodiment (FIG. 1) the air separator 2 is formed by a static air separator which is provided in the usual way with guide vanes 8 arranged in a ring, an oversize material hopper 9, an upper fine material outlet 10 and—at the lower end of the oversize material hopper 9—with a lower tailings outlet 11 which if required can also have a flap valve—which is not shown here.

The fresh material for grinding which is to be crushed is delivered (arrow 12) to the roller mill 1 via a fresh material feed chute 13 which is co-ordinated with the roller mill 1 in such a way that the material for grinding passes onto the grinding track 5*a*. This fresh material feed chute 13 has a base 13*a* which runs obliquely downwards and to which in this example two inlet channels 14 and 15 for separating air are attached. These separating air inlet channels 14, 15 can be regulated or adjusted in their flow cross-section for example with the aid of slide valves, so that the quantity of separating air and the effectiveness of the separating air on the material for grinding to be delivered to the roller mill 1 can be regulated.

It is of particular importance that in the region between the tailings outlet 11 of the air separator 2 and the point where oversize material (tailings) to be returned is reintroduced into the roller mill 1 a secondary separating device is arranged for separating out fine particles from this oversize material. For this purpose in the embodiment according to FIG. 1 the tailings outlet 11 is connected by a screw conveyor 16 (or also by another suitable mechanical conveyor device) to the fresh material feed chute 13, so that this screw conveyor 16—when viewed in the direction of conveying the material (arrow 12)—is connected to the fresh material feed chute 13 in the region before the separating air inlet (inlet channels 14 and 15) into the fresh material feed chute 13. Thus, as will be explained in greater detail, the fresh material feed chute 13 provided with the separating air inlet channels 14 and 15 simultaneously forms a kind of primary separating device for the fresh material for grinding (arrow 12) and secondary separating device for the oversize material to be returned from the air separator 2 to the roller mill 1 (arrow 17).

During operation of this first embodiment which is illustrated in FIG. 1, a gas stream (arrow 18), preferably kiln gas, is drawn in by means of a ventilator (not shown in detail) which is connected to the fines outlet 10 of the device housing 3 and through a louvre air ring 19 surrounding the grinding table and passed to the air separator 2 (arrows 20) together with the material for grinding which has been sufficiently crushed and is discharged over the edge of the grinding table 5. In the air separator 2 oversize material (arrow 17) is precipitated and is delivered via the oversize material hopper 9, the tailings outlet 11, the screw conveyor 16 and the material feed chute 13 (together with the fresh material for grinding) back to the grinding track 5*a* of the roller mill 1, whilst the fine material (arrow 21) leaves the air separator 2 through the stub-like fines outlet 10.

According to the invention, with the aid of the additional separating air (arrows 22) introduced via the separating air inlet channels 14 and 15 into the fresh material feed chute 13 both primary separation of the freshly delivered material for grinding (arrow 12) and secondary separation of the oversize material (arrow 17) returned via the screw conveyor 16 is carried out in such a way that all the fine particles (arrows 23) separated out by the transverse flow which is produced can be delivered directly to the air separator jointly and together with the material for grinding which has been sufficiently crushed in the roller mill 1. In this way a sufficiently high proportion of fine and ultra-fine material is separated out of the entire quantity of material for grinding to be delivered to the grinding track 5*a*, not only out of the freshly delivered material for grinding but also out of the oversize material (tailings) returned from the air separator 2, before the material for grinding reaches the grinding track 5*a* and the grinding tools (grinding rollers 6). Thus a considerable increase in efficiency of the roller mill 1 and a marked improvement in the grinding work in this roller mill can be achieved.

Figure 2:
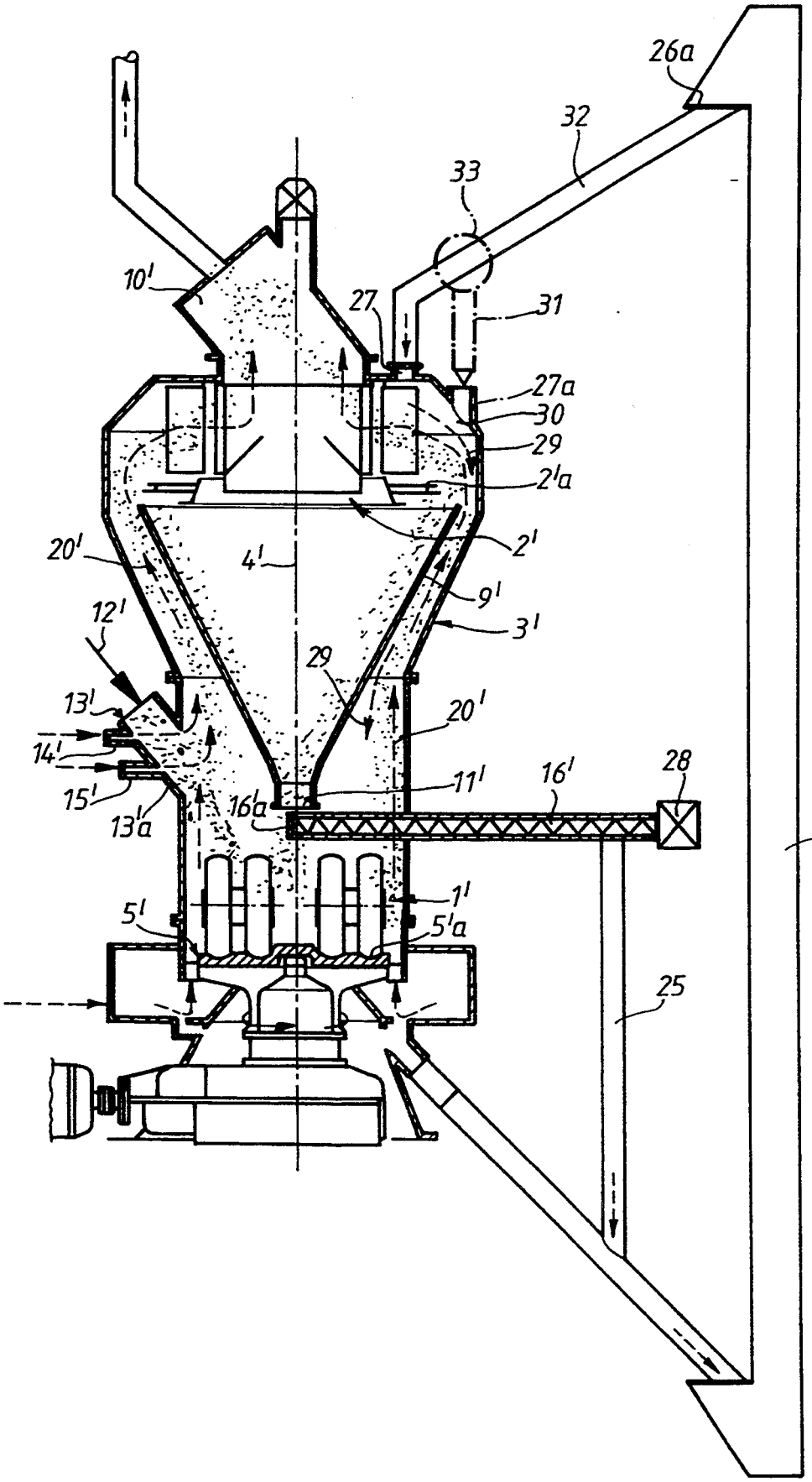
FIG. 2 shows a schematic view of a second embodiment of the crushing apparatus according to the invention, also in the form of a roller mill with a separator arranged above it and with an outer lift-over conveyor.

In the embodiment illustrated in FIG. 2, for the sake of simplicity parts of the apparatus which are the same or of similar construction are designated by the same reference numerals with the addition of a prime, so that a repeated detailed description of these parts is unnecessary.

Also in this second example it may be assumed that a roller mill 1' with a vertical axis 4' is provided as the crushing device and that the separator is an air separator 2' arranged immediately above the roller mill 1' in a common device housing 3', in which case fresh material for grinding (arrow 12') is delivered to the roller mill 1' via a similar fresh material feed chute 13' the base of which is again provided with regulable inlet channels 14' and 15' for separating air.

In this example according to FIG. 2 it may be assumed—as a variant of the example according to FIG. 1—that the air separator 2' is a dynamic air separator which has separating elements which can be driven in rotation about the vertical device axis 4' with a rotating distributor plate 2'*a*. Apart from this the air separator 2' also has a fines outlet 10', an oversize material hopper 9' and a tailings outlet 11'.

In contrast to the first embodiment described above, the screw conveyor 16' does not connect the tailings outlet 11' of the air separator 2' to the fresh material feed chute 13' which acts simultaneously as a separating device, but the screw conveyor 16' preferably conveys only an adjustable proportion of the oversize material flowing off out of the tailings outlet 11' along path 25 to a separately erected lift-over elevator (as a mechanical lift-over conveyor) 26 which conveys this proportion of oversize material—optionally together with a proportion of the crushed material falling downwards from the grinding table—to a material inlet connection 27 for the air separator 2' which in this embodiment also simultaneously forms the secondary separating device for the proportion of oversize material (tailings) to undergo secondary separation.

Thus the proportions of oversize material conveyed out of the device housing 3' by the screw conveyor 16' pass from the material outlet 26*a* of the lift-over elevator via the material inlet connection 27 onto the distributor plate 2'*a* of the air separator 2', so that the proportion of oversize material which is mechanically discharged and lifted over undergoes a secondary separation in this dynamic air separator 2', as a result of which the desired relief of the roller mill of fine material (finished material) which is already sufficiently crushed can be brought about. As is indicated in FIG. 2 by the broken arrows 29, from the feed material thrown off outwards by the distributor plate 2'*a* a corresponding proportion of oversize material is spun out and guided along the inner wall of the device housing 3' directly to the grinding table 5'*a*, while other proportions of oversize material are guided centrally downwards via the oversize material hopper 9' to the tailings outlet 11'.

The proportion of oversize material not conveyed out of the device housing 3' by the screw conveyor 16' can be delivered directly to the grinding track 5'*a*, but also optionally for secondary separation in the fresh material feed chute 13'.

Whereas in the previously described embodiment of the example according to FIG. 2 the material inlet connection 27 of the air separator 2' opens above the annular distributor plate 2'*a*, if required or additionally it is also possible for the material inlet stub or a further material inlet connection of the air separator 2' to open in the manner indicated at 27*a* directly into the annular upper outer region 30 of the air separator through which the mixture of material for grinding and air (arrows 20') conveyed from below from the grinding table 5'*a* reaches this air separator 2'. As is indicated in this connection by dash-dot lines in FIG. 2, this second material inlet connection 27*a* can be connected by a connecting line or a partial line 31 to the material outlet 26*a* of the lift-over elevator. Furthermore, there is also the possibility—as also indicated by dash-dot lines—for the line 32 connecting the material outlet 26*a* of the lift-over elevator to the (first) material inlet connection 27 to be provided with a deflector or flap valve 33 so that according to requirements the lifted proportions of oversize material are delivered via the first material inlet connection 27 to the distributor plate 2'*a* or are introduced via the second material inlet connection 27 directly into the annular outer region 30 of the air separator, and there is also the possibility of arranging a type of distribution device at 33 so that some of the lifted proportions of oversize material can be delivered to the distributor plate 2'*a* and some can be introduced directly into the outer region 30 of the air separator. The first material inlet connection 27 and the second material inlet connection 27*a* can advantageously be arranged so that they are offset, relative to one another in the peripheral direction (e.g. by about 180°).

If the lifted and returned proportions of oversize material bypass the distributor plate 2'*a* and are fed directly into the annular outer region 30 of the air separator, then this takes place against the rising gas stream or mixture of material for grinding and air (arrows 20'), so that at least the particularly large proportions of material—corresponding to the arrows 29—fall directly in front of the crushing tools (grinding rollers) of the roller mill 1' onto the grinding table 5'*a*. Thus in a particularly advantageous manner the fines are separated out of the returned tailings by the upwardly directed gas stream and a particularly good distribution of material for grinding on the grinding table and thus smoother running of the roller mill 1' are achieved, and moreover it is also possible in an advantageous manner for an existing separator without a distributor plate, that is to say a static air separator, to be appropriately adapted simply and economically.

In order for the distribution in quantity terms of the oversize material running out through the tailings outlet 11' of the air separator 2' to be carried out in a suitable manner, an adjustable quantity distribution device can be arranged after the tailings outlet 11', this quantity distribution device being connected on the one hand to the grinding table 5' (optionally via the fresh material feed chute 13') and on the other hand—via the screw conveyor 16' and the lift-over elevator 26—to the dynamic air separator 2' which here acts simultaneously as a secondary separating device. Such an adjustable quantity distribution device can be constructed in any suitable way. In the example according to FIG. 2 it may be assumed that the screw conveyor 16' has a drive 28 which can be regulated to vary the flow rate of material through the conveyor in such a way that at the inlet end 16'*a* of the screw conveyor 16' more or less quantity of material is permitted to enter the conveyor which is then passed to the grinding table 5' or optionally to the fresh material feed chute 13'.

The crushing work and effect and the separating work of this embodiment (FIG. 2) within the device housing 3 or the material feed chute 13' are otherwise the same as has been described in detail with the aid of FIG. 1.

We claim:

1. A method of crushing material comprising:

a) delivering fresh raw material along a path leading to a crushing zone;

b) separating fines from said raw material upstream of said crushing zone and delivering the remainder of the raw material to enter the crushing zone;

c) crushing the raw material in said crushing zone to produce relatively finer particles and relatively coarser particles; entraining particles resulting from the crushing of the material and conveying them along a first path away from the crushing zone;

d) delivering the entrained particles to a primary separator and removing at least some of the relatively finer particles and returning relatively coarser particles back to the crushing zone along a second path that is different from the first path; capturing at least a portion of the relatively coarser particles upstream of the crushing zone and subjecting them to a secondary separation treatment to remove additional relatively finer particles from the captured particles; and e) delivering the remainder of the captured particles to the crushing zone for further crushing.

2. The method of claim 1 including combining the captured particles with the entrained particles and delivering them into the primary separator.

3. The method of claim 2 including combining the captured particles with raw material upstream from the crushing zone and removing very fine particles from the combined captured particles and raw material and thereafter combining such very fine particles with the entrained particles and delivering them together into the primary separator.

4. Apparatus for crushing material of differing particle size, said apparatus comprising:

a crushing device having a crushing zone for crushing material;

a material feed device communicating with said crushing zone for delivering thereto a stream of fresh raw material to be crushed;

air inlet means for introducing at least one air stream from an air source into said stream of raw material for removing fine particles from the raw material upstream of the material crushing zone;

first separation means communicating with said crushing device for separating fines resulting from the crushing of the material in said crushing zone and conveying them along a first path and at least partially separating the fines into relatively finer particles and relatively coarser tailings particles, said first separating means having discharge means for discharging said relatively finer particles from said crushing device and tailings return means for returning relatively coarser tailings particles toward said crushing zone along a second path that is different from said first path and discharging said relatively coarser tailings particles through a tailings outlet above said crushing zone; and second separation means communicating with said tailings return means upstream of said crushing zone for capturing at least a portion of said relatively coarser tailings particles discharged from said tailings outlet and further separating relatively finer particles remaining in said relatively coarser tailings particles.

5. The apparatus of claim 4 wherein said second separation means includes conveyor means having an inlet communicating with said tailings return means and an outlet communicating with said feed device upstream of said air inlet means for transporting said relatively coarser tailings particles from said return means to said feed device for combining with said raw material.

6. The apparatus of claim 5 wherein said material feed device comprises a feed chute extending obliquely downwardly toward said crushing zone and said air inlet means comprises at least one air inlet channel arranged transversely of said feed chute for directing a secondary stream of air transversely across said feed chute upstream of said crushing zone and downstream of where said relatively coarser tailings particles are introduced into said feed device.

7. The apparatus of claim 4 wherein said crushing device comprises a roller mill having grinding rolls supported within a housing on a grinding table that is rotatable about a vertical axis, said first separation means including an air separator above said grinding rolls having said tailings outlet above said grinding rolls and an inlet axially above said outlet, said second separation means including a conveyor communicating at one end with said tailings outlet for directing at least a portion of the relatively coarser tailings particles away from said crushing zone.

8. The apparatus of claim 7 wherein said grinding mill includes lift-over conveyor means for conveying crushed material from said crushing device to said inlet of said air separator, said conveyor means being coupled at its opposite end to said lift-over conveyor means to combine said relatively coarser tailings particles and the crushed material.

9. The apparatus of claim 8 wherein said air separator includes a distributor plate adjacent said inlet.

10. The apparatus of claim 8 wherein said air separator includes an annular upper portion into which said inlet directly opens, and said first separation means includes means forming a gas stream for entraining said fines resulting from the crushing of the material and conveying them along an upward path extending above said grinding rolls into said annular upper portion.

11. The apparatus of claim 7 wherein said conveyor has a variable feed screw drive mechanism.

12. Apparatus for crushing material of differing grain size comprising:

a housing having a material crushing zone therein;

a material feed device in communication with said crushing zone for delivering thereto fresh raw material to be crushed;

crushing means for crushing the material delivered to said crushing zone;

means forming a primary gas stream for entraining fines resulting from the crushing of said material and conveying them along an upward first path, said entrained fines including relatively finer particles and relatively coarser particles;

means for introducing at least one air stream into said material feed device transversely of the flow direction of said primary gas stream and upstream of said crushing zone for separating relatively fine particles from said raw material before said raw material enters said crushing zone and directing such fine particles into the primary gas stream for combined entrainment and conveyance with said fines;

primary separator means athwart said first path for separating at least a portion of said relatively fine particles from the entrained combined material;

discharge means for discharging the separated relatively fine particles from said housing;

return means for directing the remaining entrained material back toward said crushing zone along a second path different from said first path; and secondary separator means between said return means and said crushing zone for capturing and further separating out any additional portions of said relatively fine particles from said remaining material and permitting the remainder of said material to reenter said crushing zone for further crushing.

13. The apparatus of claim 12 wherein said secondary separator means redirects said remaining material back into said primary air stream for secondary separation treatment.

14. The apparatus of claim 12 wherein said secondary separator means includes a conveyor positioned downstream of said return means and upstream of said crushing zone operable to convey said remaining material away from said crushing zone for said secondary separation treatment.

15. The apparatus of claim 12 wherein said material feed device comprises a feed chute extending obliquely downward in relation to said housing toward said crushing zone, said chute having at least one air inlet channel arranged transversely of said feed chute for directing said secondary stream transversely across said feed chute upstream from said crushing zone for separating said relatively fine particles from the material conveyed through said chute and delivering such separated particles to said primary gas stream for combined entrainment with said fines resulting from said crushing of said material.

16. The apparatus of claim 15 wherein said secondary separator means includes a conveyor extending from the outlet of said return means upstream of said crushing zone to said feed chute upstream of said air inlet for conveying at least some of said remaining returned material into said feed chute for combined delivery toward said crushing zone with said fresh material.

* * * * *

UNITED STATES PATENT AND TRADEMARK OFFICE

CERTIFICATE OF CORRECTION

PATENT NO. : 5,381,968

DATED : January 17, 1995

INVENTOR(S) : Ludger Lohnherr et al

It is certified that error appears in the above-indentified patent and that said Letters Patent is hereby corrected as shown below:

Column 1, line 7, after "for" (second occurrence) insert -- grinding of differing grain size. --.

Column 1, line 62, after "only" insert -- for --.

Signed and Sealed this

Second Day of May, 1995

Bruce Lehman

*Attest:*

BRUCE LEHMAN

*Attesting Officer*

*Commissioner of Patents and Trademarks*